United States Patent [19]

Bellantuono

[11] Patent Number: 4,471,984

[45] Date of Patent: Sep. 18, 1984

[54] LEVER HANDLE ASSEMBLY

[75] Inventor: Morris P. Bellantuono, New Britain, Conn.

[73] Assignee: Emhart Industries, Inc., Farmington, Conn.

[21] Appl. No.: 481,029

[22] Filed: Mar. 31, 1983

[51] Int. Cl.[3] ..... E05B 3/00

[52] U.S. Cl. ..... 292/350; 292/358

[58] Field of Search ..... 292/350, 351, 356–358

[56] References Cited

U.S. PATENT DOCUMENTS

| | | | |
|---|---|---|---|
| 1,484,406 | 2/1924 | Ottinger | 292/350 |
| 2,080,174 | 5/1937 | Hart et al. | 292/356 X |
| 2,461,085 | 2/1949 | Roy | 292/356 |
| 2,702,204 | 2/1955 | Collier | 292/358 X |
| 2,947,561 | 8/1960 | Holden | 292/350 X |

*Primary Examiner*—Gary L. Smith
*Assistant Examiner*—Thomas J. Dubnicka
*Attorney, Agent, or Firm*—H. Samuel Kieser

[57] ABSTRACT

Lever handle assembly for a door lock which includes an adapter plate mounted on the door, a spindle extending through said adapter plate from said door, a spindle having an axial bore therein, an adjusting screw, and a lever. The adjusting screw extends through the spindle and is threaded into a bore in a member that is fixed, with respect to the door, in an axial direction toward the adapter plate. The lever is mounted on the spindle and is connected to a connecting portion on the spindle.

10 Claims, 5 Drawing Figures

18
20
22
24
26
28
30
32
34
36
38
40
41
42
44
48
54
56
58
60
62
64
65
66
68
70
72
74
76
78
80
82
84
85
86
90

LEVER HANDLE ASSEMBLY

BACKGROUND OF THE INVENTION

This invention relates generally to a lever handle assembly for use with locks, and more particularly to a lever handle assemble for use with mortise locks.

One form of a lever handle assembly that has been used in the past has included a threaded inside spindle having a square cross section which was threaded onto a reduced male portion of an outside spindle to which the outside lever was attached by a roll pin. The inside lever was threaded onto the threaded inside spindle until it comfortably fit within the bushing portion of an adapter plate which was mounted on the door. The inside lever was secured to the inside spindle by means of set screws which bottomed out on the flat portion of the spindle. The levers were used to operate the latch bolt of a mortise lock.

The threaded spindle provided a means for adjusting the axial position of the lever to compensate for various door thicknesses. However, the torque caused by repeated turning of the lever handle could result in the set screw damaging the spindle and the lever handle could work loose. Additionally, due to machining requirements in forming the reduced threaded male portion on the outside spindle, an undercut was provided at the point the male portion joined the outside spindle body. If the gap between the inside and outside spindle heads was not properly maintained, upon operating the lever, the two spindles could bind, and excessive force and pressure on the lever could cause the outside spindle to fail at the undercut.

SUMMARY OF THE INVENTION

It is an object of the present invention to provide an improved lever handle assembly for a lock. More particularly, it is an object of the present invention to provide a lever handle assembly which is less susceptable to wear and breakage.

These and other objects of the invention may be accomplished through the provision of a lever handle assembly including an adapter plate mounted on the wall and a noncircular spindle extending from the lock through the adapter plate and having an axially extending bore therein. An adjusting screw extends through the spindle and has a threaded end portion in the door and a connecting portion outside of the door. Means fixed with respect to said door in an axial direction toward said adapter plate has a threaded bore, the adjusting screw being threaded into said threaded bore. A lever member is mounted on the spindle for rotation therewith. Means is provided to connect the lever to the connecting portion of the adjusting screw to hold said lever on said spindle in proper position with respect to the adapter plate.

DETAILED DESCRIPTION

Figure 1:
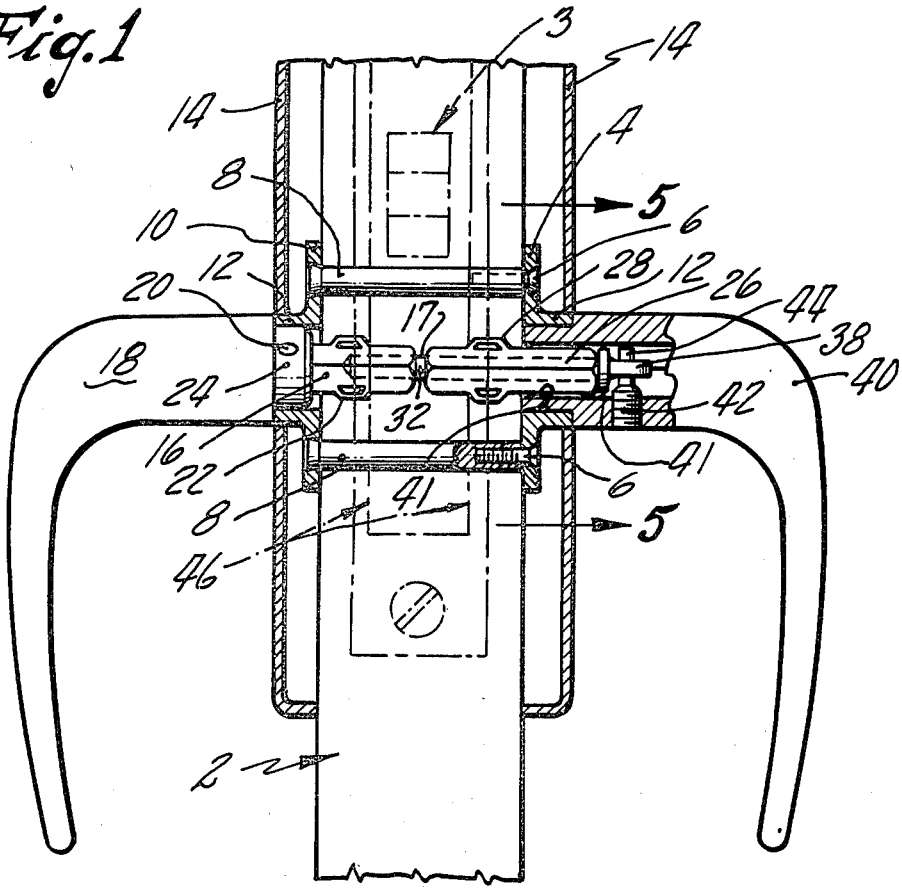
FIG. 1 is a verticle side view, partially in section, of a lever handle assembly constructed in accordance with the present invention and showing it in relationship to a door and mortise lock and showing the handles rotated 90° from their normal position to show details of construction.

Referring to the drawings and specifically FIG. 1, the lever handle assembly of the present invention is shown mounted on a door 2 in which a lock 3 has been mounted. An inside adapter plate 4 is held flush against the inside panel of the door 2 by means of screws 6 extending into posts 8 which extend through the door from an outside adapter plate 10 which is held flush against the outside panel of the door 2. Each of the adapter plates 4 and 10 include bushing portions 12 extending away from the door 2. An escutcheon or rose 14 may be provided on the inside and outside panels of the door in a conventional manner.

An outside spindle 16 of noncircular cross-section, square in the case of preferred embodiment, is inserted into a mating bore in the end of the outside lever 18 and is held in place by means of a roll pin 20. Diametrically opposite corners of the outside spindle 16 are swaged to provide diammetically opposed nubs 22.

The outside lever 18 is mounted on the door 2 by inserting the forward end portion 24 thereof into the busing portion 12 of the outside adapter plate 10 with the outside spindle 16 extending into the door 2. An inside spindle 26 is provided of non-circular cross-section, square according to the preferred embodiment, and includes swaged nubs 28 extending from diammetrically opposed corners. The inside spindle 26 also includes an axial thrubore 30 through which an adjusting screw 32 freely extends. The adjusting screw 32 has a threaded end portion 34 threaded into a threaded bore 36 in the forward face of the outside spindle 16.

The other end of the adjusting screw is provided with an eyelet portion 38. The inside lever 40 is provided with a bore 41 in its end portion having a cross sectional configuration to mate with the cross section of the inside spindle 26, square in the case of the preferred embodiment. The inside lever 40 inserted over the eyelet portion 38 of the adjusting screw 32 and a portion of the inside spindle 26 and is secured thereto by means of a dowel set screw 42 theaded in the lever 40 and having a dowel portion 44 extending through the eyelet portion 38 of the adjusting screw 32. The width of the eyelet portion 38 should be such that it will snugly fit between two corners of the bore 41 in the lever 40 when the lever is inserted on the spindle 26 to align the eyelet portion 38 with the dowel set screw 42.

Assuming the proper openings have been made in the door 2, the lock 3 installed, the adapter plates 4 and 10 and the roses or eschutcheons 14 mounted, the lever handle assembly may be installed by inserting the outside spindle 16 with its attached lever 18 through the outside adapter plate 10 until the forward end portion 24 of the outside spindle 16 fits in the bushing portion 12 of the outside adapter plate 10 and the nubs 22 of the outside spindle engage the outer wall of the mortise case indicated by the dotted line 46.

The adjusting screw 32 is inserted through the thrubore 30 in the inside spindle 26 and the spindle 26 and adjusting screw 32 inserted through the bushing portion 12 of adapter plate 4 and the screw 32 threaded into the bore 36 in outside spindle 16. The screw 32 should be threaded in until the eyelet portion 38 thereof is spaced the proper distance from the adapter plate. For this purpose a gauge may be provided to determine the proper distance. With the inside spindle 26 inserted and the adjusting screw 32 threaded in the outside spindle, the inside lever 40 is inserted on the inside spindle 26 and the dowel set screw 42 threaded in the inside lever 40 with the dowel portion thereof passing through the eyelet portion 38 of the adjusting screw 32. The distance of the eyelet portion 38 from the adapter plate 4 should be such that when the dowel set screw 42 is aligned with and passes through the eyelet portion, the forward portion 41 of the inside lever 40 is snugly received within the bushing portion 12 of the adapter plate 4 but can rotate without binding. The nubs 28 on the inside spindle 26 limit the travel of the inside spindle 26 toward the outside spindle 16 by engaging the mortise case 46 so that a gap 17 is maintained between the two to prevent binding of the inside and outside spindles during operation of the lever. In addition, the nubs 28 prevent the spindles 16 and 26 from being inserted into the lock past the centerline and thereby engaging the wrong knub of the lock mechanism.

Figure 3:
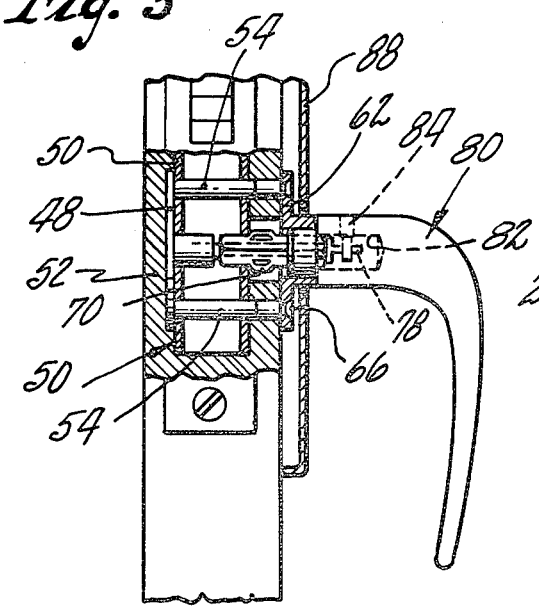
FIG. 3 a verticle side view partially in section of a single lever handle assembly showing it in relationship to a door and mortise lock, and showing the handle rotated 90° from its normal position to show details of construction.
Figure 5:
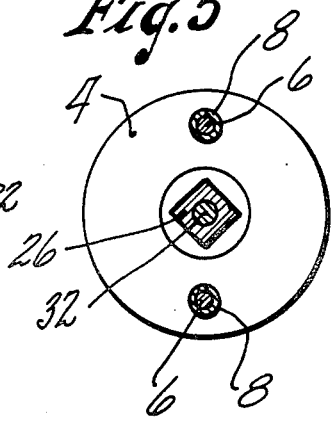
FIG. 5 is a cross-sectional view taking along the lines 5—5 of FIG. 1.
Figures 2, 4:
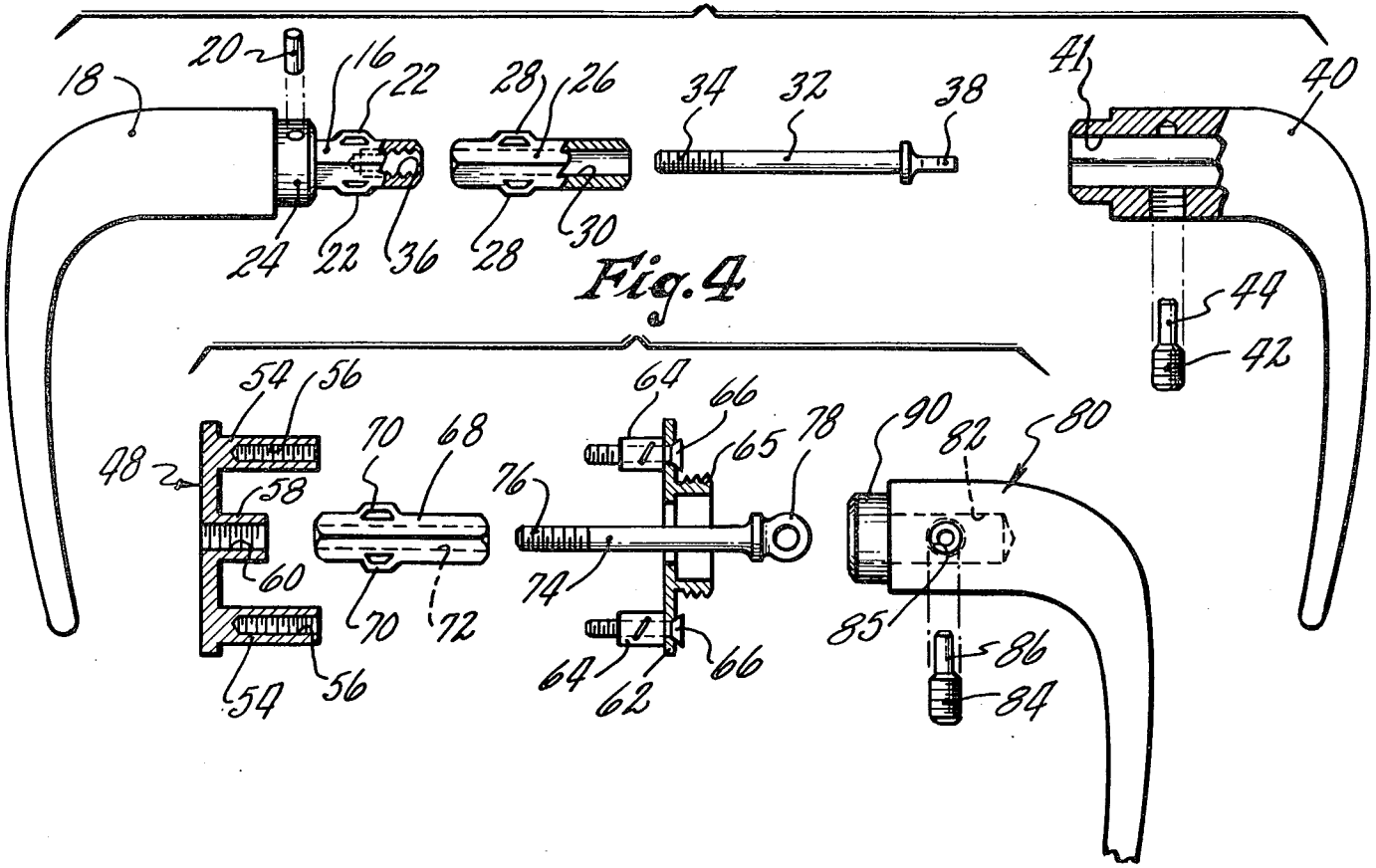
FIG. 2 is an exploded view of the various components of the lever handle assembly shown in FIG. 1.
FIG. 4 is an exploded view of the single lever assembly shown in FIG. 3.

FIG. 3 shows a lever handle assembly where only one lever is placed. In this case an inside adapter plate 48 is provided against the side wall of the case 50 of the mortise lock within the door 52. The inside adapter plate 48 includes posts 54 extending through the mortise case 50 and having internally threaded bores 56. The adapter plate 48 also includes a central post 58 of lesser length than the posts 54 which is also provided with an internally threaded bore 60. A surface adapter plate 62 is mounted flush against the outside of the door 52 and includes spaces 64 in alignment with the posts 54 and a bushing portion 65. Screw member 66 passes through the spaces 64 and are threaded into the bores 56 of the posts 54 on the inside adapter plate 48. A spindle 68 is provided and is similar to the inside spindle 26 of the modification shown in on FIG. 1 in that it has an noncircular cross-section, square in the preferred embodiment, and has diammetrically opposed nubs 70 and a thrubore 72. An adjusting screw 74, is provided and is similar to that shown in the embodiment of FIG. 1 in that it includes threads 76 at one end and an eyelet portion 78 at the other end. The adjusting screw 74 freely extends through the spindle 68 and is threaded into bore 60 in the central post 58 on the inside adapter plate 48. A lever 80, which has a bore 82 in its end portion having a cross-section to mate with the cross-section of the spindle 68, is mounted over the spindle 68 and the eyelet portion 78 of the adjusting screw 74, and secured thereto by means of a dowel set screw 84 which extends in a threaded opening 85 in the side of the lever 80 with the dowel portion 86 thereof passing through the eyelet portion 78 of the adjusting screw 74.

In installing the single lever, the inside adapter plate 48 is inserted into the lock on the side opposite the trim. The lock is then installed in the door 52. The surface adapter plate 62 is applied to the face of the door, and the screws 66 are drawn up firmly. Suitable trim is applied such as a rose or a eschutcheon 88 and the adjusting screw 74 is inserted through the spindle 68. The spindle 68 and adjusting screw 74 are inserted through the surface adapter plate 62 and the screw 74 threaded into the bore 60 of small post 58 on the inside adapter plate 48 until the eyelet portion 78 of the adjusting screw 74 is the proper distance from the adapter plate 62. The lever 80 is inserted on the spindle 68 and the dowel pin 84 is threaded into the lever 80 so that the dowel portion 86 thereof extends through the eyelet portion 78 of the adjusting screw 74. The eyelet portion 78 should be positioned from the adapter plate 62 so that when the lever 80 is attached and the dowel set screw 84 is threaded in, the lever will have its forward portion 90 snugly received in the bushing portion 65 of the surface adapter plate 62 with the lever 80 free to rotate without binding. The nubs 70 of the spindle 68 engage the outside of the mortise case 50 to prevent the end of the spindle from binding on the central post 58 of the inside adapter plate 48.

While reference has been made above to a specific embodiment, it will be apparent to those skilled in the art that various modifications and alterations may be made thereto without departing from the spirit of the present invention. Therefore, it is intended that the scope of this invention be ascertained by reference to the following claims.

What is claimed is:

1. A lever handle assembly for a door lock comprising an adapter plate for mounting on a door, a noncircular spindle extending from the lock through the adapter plate and having an axially extending bore therein, an adjusting screw freely extending through said spindle and having a threaded end portion in said door and a connecting end portion outside of said door, means fixed with respect to said door in an axial direction toward said adapter plate having a threaded bore therein, said adjusting screw being threaded into said threaded bore, a lever member mounted on said spindle for rotation therewith, and means connecting said lever to said connecting portion to hold said lever on said spindle in proper position with respect to said adapter plate.

2. A lever handle assembly of claim 1 in which said means having said threaded bore includes an inside adapter plate mounted on the sidewall of said lock and having a central post provided with an internally threaded bore.

3. A lever handle assembly of claim 2 wherein said spindle has nubs thereon for engaging the sidewall of the lock case to prevent said spindle from engaging said post.

4. A lever handle assembly of claim 1 wherein said means connecting said lever to said connecting portion includes a dowel set screw threaded in said lever and having a dowel portion passing through an eyelet portion in said adjusting screw.

5. The lever handle assembly of claim 1 wherein said adapter plate includes a bushing portion extending away from said door, and said means connecting said lever retains the forward portion of the lever in said bushing portion.

6. A lever handle assembly for a door lock comprising first and second adapter plates, one mounted on one side of the door and the other mounted on the other side of the door in alignment with each other, a first spindle having a lever attached thereto, said first spindle extending through said first adapter plate into the lock, a noncircular second spindle extending through said second adapter plate into said lock and having an axial extending bore therein, an adjusting screw extending through said second spindle and having a threaded end portion threadedly connected to said first spindle and a connecting portion outside of said door, a second lever mounted on said second spindle for rotation therewith, and means connecting said second lever to said connecting portion to hold said second lever on the spindle and both levers in proper position with respect to their respective adapter plates.

7. The lever handle assembly of claim 6 wherein each of said spindles has nubs thereon to engage the sidewall of the lock case to prevent axial engagement of the two spindles.

8. The lever handle assembly of claim 6 wherein said means connecting said lever to said connecting portion includes a dowel set screw threaded in said second lever and having a dowel portion passing through an eyelet portion on said adjusting screw.

9. The lever handle assembly of claim 6 wherein said first and second adapter plates each include a bushing portion extending outwardly from the door, and said connecting means retains the forward portion of each of said levers in the bushing portion of its respective adapter plates.

10. The lever handle of claim 6 wherein said second lever has a square cross-section.

* * * * *